US005121680A

United States Patent [19]

Nordberg

[11] Patent Number: 5,121,680

[45] Date of Patent: Jun. 16, 1992

[54] TIRE COMPACTOR AND METHOD

[76] Inventor: Henry T. Nordberg, 510 Lake Rd., Oneida, N.Y. 13421

[21] Appl. No.: 651,956

[22] Filed: Feb. 7, 1991

[51] Int. Cl.[5] ..... B65B 27/06

[52] U.S. Cl. ..... 100/012; 100/8; 100/269 R; 414/27

[58] Field of Search ..... 100/1, 6, 8, 12, 25, 100/269 R; 414/27

[56] References Cited

U.S. PATENT DOCUMENTS

| | | | |
|---|---|---|---|
| 2,920,555 | 1/1960 | Sherriff | 100/12 |
| 3,129,658 | 4/1964 | Valente | 100/12 |
| 3,195,444 | 7/1965 | McClean | 100/12 |
| 3,212,429 | 10/1965 | Fay | 100/12 |
| 3,675,569 | 7/1972 | Moor | 100/12 |
| 3,705,658 | 12/1972 | Harris . | |
| 3,802,337 | 4/1974 | St. Hilaire . | |
| 3,955,491 | 5/1976 | McMahon | 100/12 |
| 4,141,396 | 2/1979 | McCallister . | |
| 4,155,300 | 5/1979 | Baltschun | 100/269 R |
| 4,222,323 | 9/1980 | Martindale . | |
| 4,306,826 | 12/1981 | Detwiler . | |
| 4,683,020 | 7/1987 | Portalupi et al. . | |
| 4,732,331 | 3/1988 | Hughes . | |
| 4,771,686 | 9/1988 | Triantos, Jr. . | |
| 4,793,124 | 12/1988 | Anderson . | |
| 4,805,507 | 2/1989 | Schmidt et al. . | |
| 5,615,366 | 10/1986 | Scarbrough, Jr. . | |

FOREIGN PATENT DOCUMENTS

| | | | |
|---|---|---|---|
| 3040324 | 6/1982 | Fed. Rep. of Germany | 414/27 |

*Primary Examiner*—Philip R. Coe
*Assistant Examiner*—Terrence R. Till
*Attorney, Agent, or Firm*—Wall and Roehrig

[57] ABSTRACT

A machine for compacting a row of vehicle tires is provided in which the tires are compressed between a fixed and a movable compactor plate with the movable plate being actuated by an hydraulic cylinder. A safety mandrel is inserted through the center of the tires and locked in engagement with the movable compactor plate so that the tires to be compacted cannot be misaligned or ejected from the machine during the compaction process. Four tie wires are provided for each bundle which are fed through slots and wire guides through the center of the tires and hooked about the outside to hold the tires in the compressed condition after the hydraulic pressure is released. The length of the compressed bundle is set by adjusting the position of the compacting cylinder relative to the fixed compactor plate. Movable cylinder support means are provided to prevent misalignment of the cylinder and piston rod at the extreme limits of the extended stroke of the system.

16 Claims, 5 Drawing Sheets

TIRE COMPACTOR AND METHOD

BACKGROUND OF THE INVENTION

This invention relates to an apparatus and method for compacting tires into a bundle. More particularly, this invention relates to a machine and apparatus for compacting a number of tires arranged in a side-by-side vertical row into a concentrated bundle for easy handling and disposition.

In recent years the problem of recycling or otherwise disposing of the common automobile tire has become an increasing problem in the United States and elsewhere in the world. With the increased emphasis on ecology and recycling, it is no longer possible to merely burn or bury automobile tires. Also, they are being recycled in a variety of applications and used for many other purposes. In addition to chopping up tires to form raw material for other processes, more and more applications are being found for bundles of tires in which the individual tires are fastened together to form artificial reefs and breakwaters for marinas and various other bulk/structural applications. In addition, as space for storage of used tires becomes more and more critical, the need to compress and compact tires into concentrated bundles has increased in order to save cubic storage space until proper disposition. Tires which are made to be very tough and resilient for their primary intended purpose present a formidable problem when it is desired to compact and bundle them into dense easily handled form.

Various hydraulically actuated machines have been proposed for compacting a number of tires into a bundle by a movable plate compressing a row of tires against a fixed plate. These machines generally have not been satisfactory from a safety and cylinder wear standpoint because of the long distances between plates when compacting a large number of tires. To be commercially successful, twenty to thirty tires must be compressed at a time which has meant machine lengths approaching thirty feet have been used with consequent cylinder wear and safety problems.

OBJECTS AND SUMMARY OF THE INVENTION

Accordingly, it is an object of the present invention to provide a method and apparatus for compacting a quantity of tires into a dense, easily handled bundle in a safe and efficient manner.

It is another object of the present invention to provide a machine for mechanically compressing a row of tires into a compact bundle and applying a plurality of ties to hold the bundle in the compressed configuration when removed from the machine.

It is another object of the present invention to provide an apparatus and method for safely compressing a row of tires into a compressed bundle without danger of one or more tires escaping from the bundle and injuring the operator of the machine or other people in the vicinity of the machine.

It is another object of the present invention to provide a machine for quickly and easily bundling and compacting twenty or more tires into a two foot long bundle, securely tied with four wire ties to hold the tires in compacted form for further disposition.

It is a still further object of the present invention to provide an apparatus for bundling automobile tires into compacted dense form for future disposition which machine can be safely operated over a long period of time with minimum damage and wear to the machine components in the operation of the machine.

It is a still further object of the present invention to provide an apparatus for bundling long rows of tires into a dense compact bundle having a length of one to three feet which bundle can be easily handled with ordinary material handling equipment for further processing and disposition.

BRIEF DESCRIPTION OF THE DRAWINGS

These and other and further objects of the invention, together with additional features contributing thereto and advantages accruing therefrom will be apparent from the following description of a preferred embodiment shown in the accompanying drawings in which.

DETAILED DESCRIPTION OF THE PREFERRED EMBODIMENT

Figure 1:
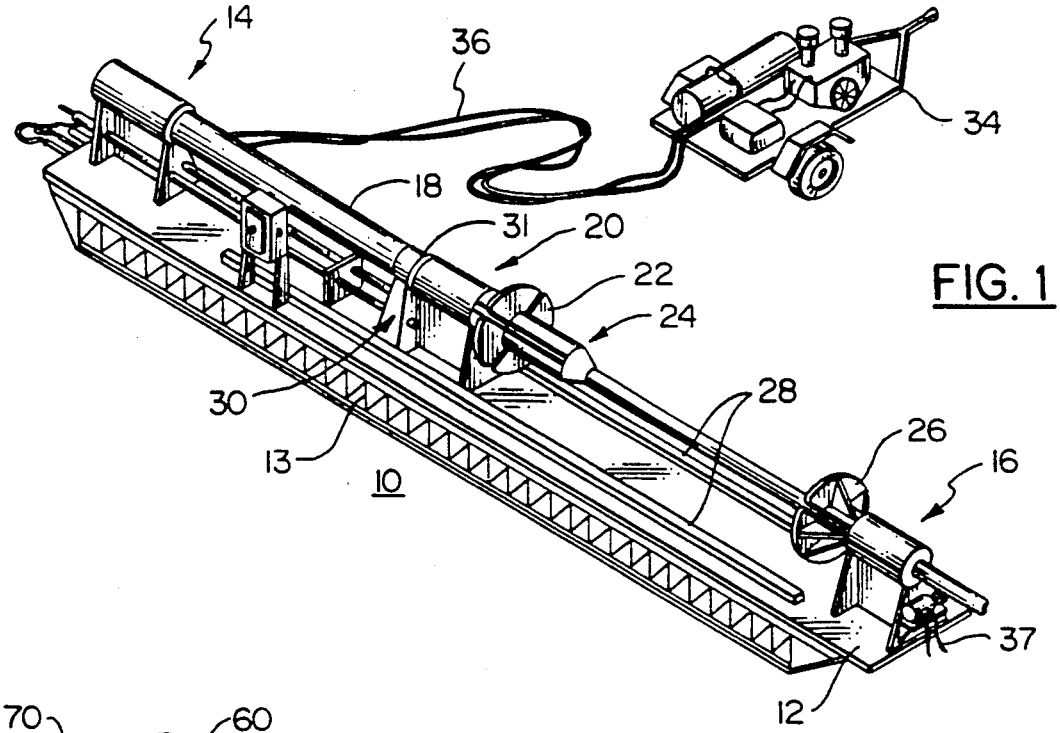
FIG. 1 is a perspective view of a machine in accordance with the present invention.
Figure 3:
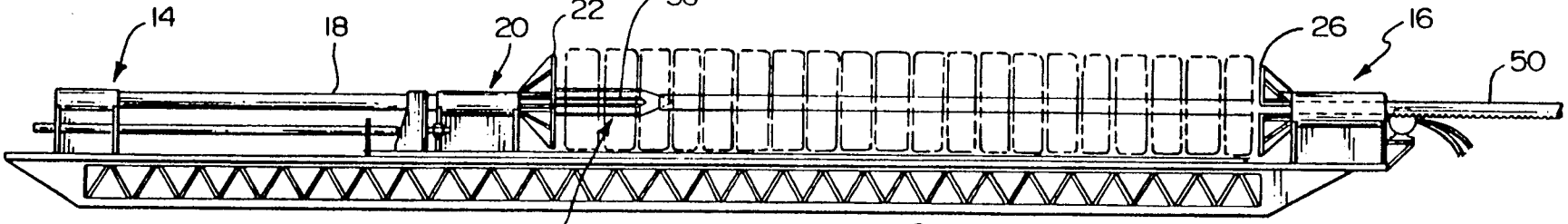
FIG. 3 is a side elevation of a machine in accordance with the present invention at the start of a compaction cycle.
Figure 4:
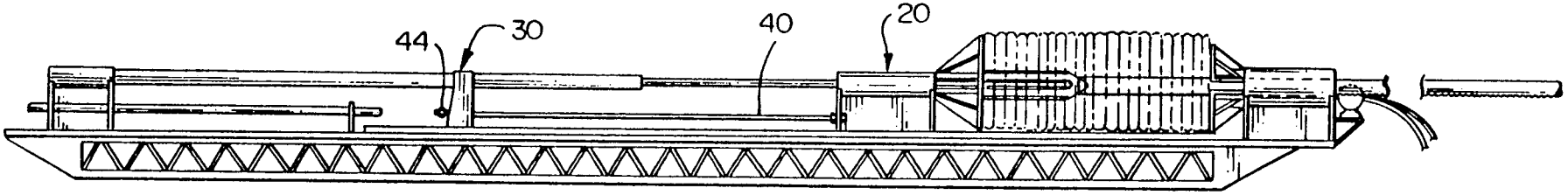
FIG. 4 is a view similar to FIG. 3 partway through the compaction cycle.
Figure 5:
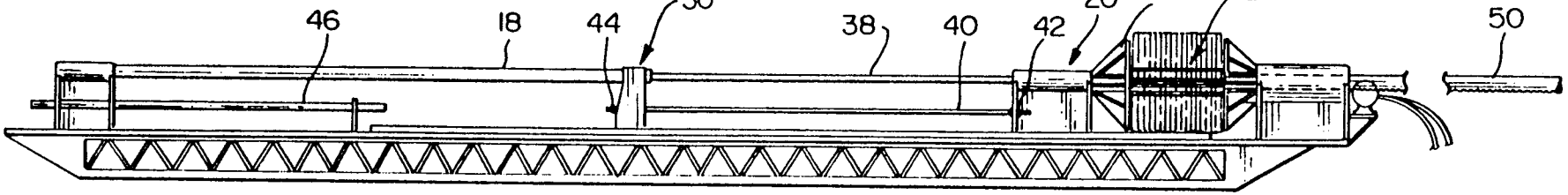
FIG. 5 is a view similar to FIG. 4 at the end of the compaction cycle.
Figure 6:
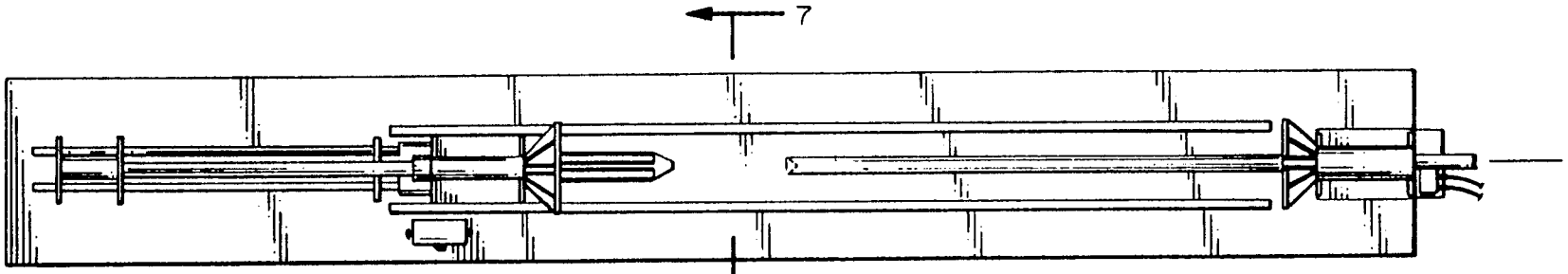
FIG. 6 is a top plan view of the machine of FIG. 1.
Figure 10:
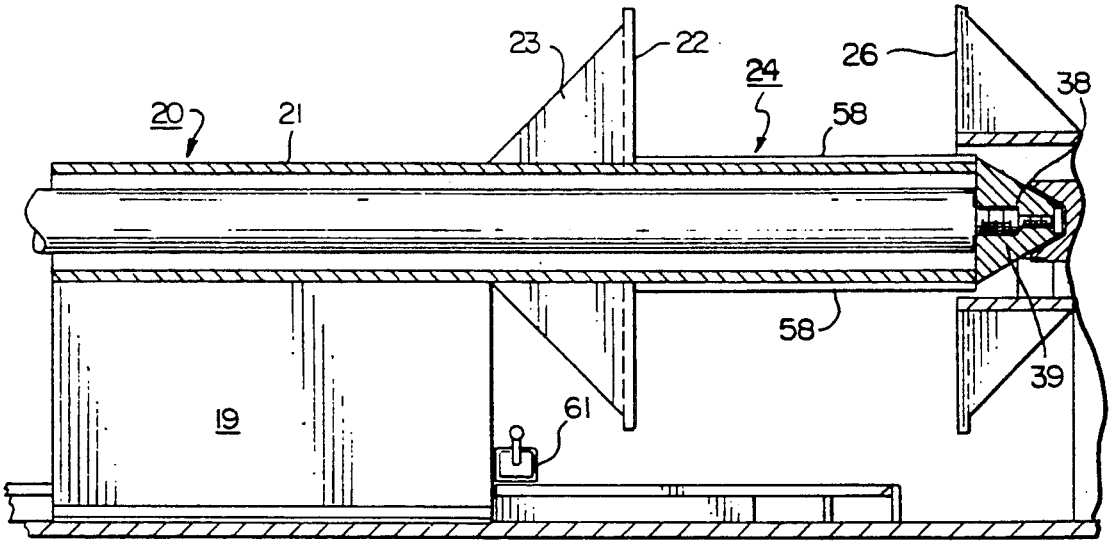
FIG. 10 is a partial cross-sectional view of the fixed plate end of the apparatus with the movable probe compactor plate shown in the compacted position.

Referring now to FIG. 1, the compactor machine 10 according to the present invention comprises an elongated narrow base plate 12 fixed on a frame 13. A mounting pedestal 14 for the hydraulic cylinder 18 is mounted on the left hand end of the base plate 12 in FIG. 1. Fixed at the right hand end of the base plate 12 is an end plate assembly 16 which carries stationary compactor plate 26 thereon. A tire probe assembly 20 is slidably mounted in tracks 28 on the base 12 for movement along the length of the plate 12 to and from a position in close juxtaposition with the end plate assembly 16 as shown in FIGS. 3-5. The movable probe assembly 20 includes a compactor plate 22 and a cylindrical probe 24 extending outwardly therefrom in the direction of the fixed compactor plate 26. The length of probe 24 is chosen to approximately equal the longest length of compacted tire bundles to be formed on the machine. As shown in FIG. 10 the probe assembly 20 comprises a pedestal 19 on which is mounted a cylinder 21. Cone shaped tip 39 is fixed to the end of cylinder 21 to form probe 24. Assembly 20 is joined to the end of piston rod 38 by a cap screw positioned in tip 39 and threaded into a threaded hole in the end of the rod 38. When piston rod 38 is fully retracted, the end of cylinder 18 extends into the cylinder 21. Cylinder 21 also carries thereon circular compactor plate 22 supported by braces 23.

In addition to the movable probe assembly 20 there is provided a cylinder support follower member 30 (FIGS. 3-5). Member 30 is slidably mounted within the tracks 28 at the bottom and at the top carries a cradle 31 which surrounds and supports the cylinder 18 at a predetermined spacing from the base plate 12 to maintain the cylinder 18 parallel to the base 12. As the piston rod 38 is extended from the cylinder 18 the probe assembly 20 is moved to the right in FIG. 1 and the tendency for the cylinder 18 to sag from its mounting 14 increases. The support follower 30 prevents this sagging and maintains the cylinder and piston rod in a parallel axially aligned relationship preventing undue wear and strain on the cylinder, piston and piston rod. This may be seen more clearly in FIGS. 3, 4 and 5 as the probe assembly 20 is moved further to the right. In FIGS. 4 and 5 it can be see that without the cylinder support follower 30 the cylinder 18 and the piston rod 38 when extended therefrom would definitely tend to sag at the midpoint.

The follower 30 is mounted in the tracks 28 for longitudinal motion along the length of the base plate 12. The follower 30 also slidably supports the outer surface of the cylinder 18 and slides therealong under control of the tie rods 40. Tie rods 40 are bolted or otherwise fixed to the probe assembly 20 at 42 and extend to the left in FIGS. 3-5 a distance approximately equal to the stroke of the piston rod. The tie rods pass through the support follower 30 in frictional engagement therewith and have positioned on the left-hand end stop nuts 44 (See also FIG. 13). The end of the tie rods are threaded to adjustably engage nuts 44. As the probe assembly 20 is moved to the right under the action of cylinder 18 and piston rod 38 the tie rods through the frictional engagement of follower 30 acts to pull the support follower 30 to the right from its fully recessed position of FIG. 3. Stop nuts 44 positively engage follower 30 to keep the maximum spacing a preselected distance less than the piston rod extension. This distance may be adjusted by turning nuts 44 on the rods 40.

In the reverse motion, as the probe assembly 20 is moved to the left by the piston rod 38 by reversing the flow of fluid in cylinder 18, the frictional sliding of the tie rods 40 through the follower 30 will tend to move the follower 30 to the left back toward its original starting position of FIG. 3. The tie rods 40 will tend to slide through the follower 30 and enter into the tie rod housings 46 shown at the left hand side of FIGS. 3-5. If the follower 30 has not moved fully to the left-hand position of FIG. 3 as the probe assembly 20 moves to the left, the probe assembly, when it reaches the follower 30, will continue to move it to the left until it is fully retracted to the position of FIG. 3. As shown in FIG. 4, the probe assembly 20 will tend to move the follower 30 to the right as the probe assembly 20 moves to the right, but the positive action of the nut 44 does not necessarily take over until the probe assembly 20 has moved to the full length of the tie rods 40 and the nut 44 then picks up the follower 30 and insures that it is moved to the right to fully support the extended cylinder 18 and piston rod 38. The tie rods 40 are a parallel pair to provide greater stability and uniform tracking throughout the motion from left to right.

Referring again to FIGS. 1 and 3-5 there is provided at the right-hand end a probe support tube 50 which is slidably mounted on Teflon bearings or the like(not shown) in the cylinder 15 which is mounted on pedestal 17 of the end plate assembly 16. The tube 50 acts like a mandrel and can be moved through the end plate assembly 16 and the center of the comparator plate 26 into the central opening of the tires positioned in the machine for compacting. The tube 50 has mounted thereon a rack gear 52 which extends along the length thereof and which is adapted to engage a pinion gear 54 mounted on the output shaft of a hydraulic motor 56 which can be powered from a source of hydraulic fluid 34. The hydraulic fluid source 34 is connected to motor 56 by hose 37 and also to the cylinder 18 through a hose 36. The operation and actuation of the tube 50 will be described in detail herein in connection with the operation of the machine.

Figure 7:
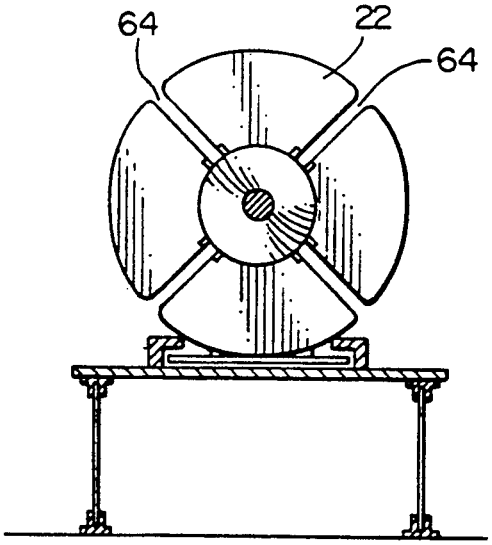
FIG. 7 is a cross-sectional view taken on line 7—7 of FIG. 6.
Figure 9:
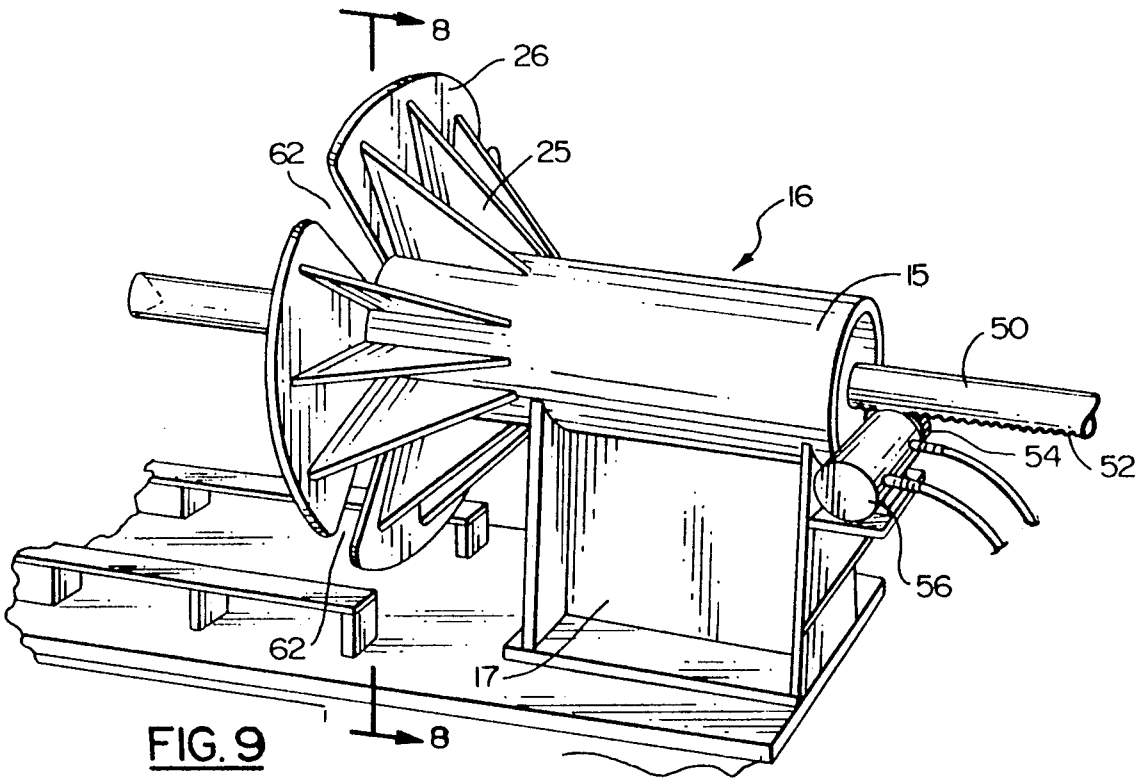
FIG. 9 is a partial perspective view of the fixed end plate assembly of the device of FIG. 1.
Figure 8:
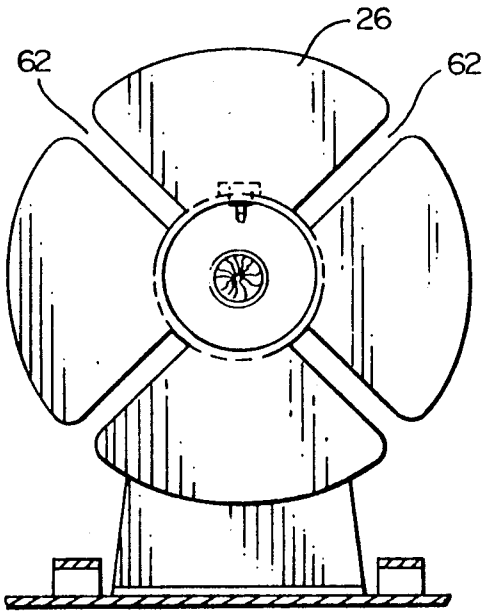
FIG. 8 is a cross-sectional view taken on line 8—8 of FIG. 9.
Figure 12:
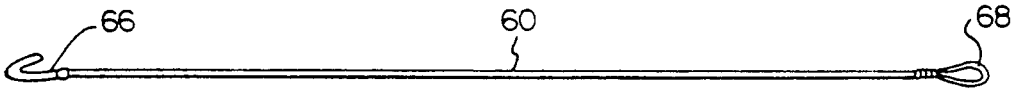
FIG. 12 is a plan view of an arrow wire.

Referring now to FIGS. 7, 8 and 9 it will be seen that the compactor plates 22 and 26 comprise a large circular plate having a diameter approximately equal to the diameter of the tires to be compacted. Each is mounted on its respective assembly 20 and 16 and has a hollow central portion through which either the probe 24 extends or the tube 50, as the case may be. Each compactor plate 22 and 26 has four slots formed therein which extend from the circumference of the plates inwardly adjacent the tubes 21 and 50. Positioned on the surface of probe 24 in alignment with slots 64, are wire guides 58 for receiving the arrowhead wires 60 shown in FIG. 12 as will be described in more detail in connection with the tying of the bundles after being compacted. The segments of the compactor plates are supported by triangular braces 23 and 25 as may be seen in FIGS. 9-11 which braces are welded or otherwise fixed to the plates and to the supporting tube members on which the plates are mounted. The probe 24 of the probe assembly extends outwardly from the movable compactor plate 22 approximately two feet which is the distance found acceptable for compacting approximately twenty standard automobile tires. Other compaction distances, of course, may be chosen for different types and styles of tires. The probe 24 is designed to interface with and lock together with the left end of tube 50 at the junction thereof as may be seen in FIG. 10 to provide full support and axial alignment of the two tubes when the tube 50 is extended through the row of tires preparatory to the compacting of the tires.

Referring now, again to FIGS. 3-5 when it is desired to compact a series of tires, the tires are placed in vertical side-by-side alignment to form a row of tires resting on the tracks 28 along the base plate 12 of the machine. As can be seen, the first two or three tires must be inserted over the probe 24 when the movable tire probe assembly is in its fully retracted left hand position of FIG. 3. The balance of the tires are inserted by standing them side by side until they just fill the space between the two compactor plates 22 and 26. At this point the hydraulic motor 56 is actuated and the probe support tube 50 is caused to move through the interior of the tires until it contacts and locks up with the probe 24.

This may be sensed by a limit switch 61. This interlock can be seen at FIG. 10 and tube 50 forms a support and continuous tubular insert within the tires to assist in locating the tires and to insure that the tires cannot be displaced out of alignment as the compacting action begins to take place.

Once the tube 50 has been moved into position and against the probe 24, the hydraulic cylinder 18 is actuated and the tire probe assembly 20 is moved to the right by the action of the cylinder 18 and the piston rod 38. The piston rod 38 is connected to the cone shaped tip 39 of the probe 24 which interlocks with the end of tube 50. As hydraulic fluid enters the cylinder 18 and pushes the piston and piston rod 38 to the right moving the probe assembly to the right, the probe pushes the tube 50 back out through the fixed end compactor plate assembly 16 as it compacts the tires into tighter and tighter compression as shown in FIGS. 4 and 5.

As previously described, the movement of the probe assembly 20, through the tie rods 40, begins to pick up the support follower 30 to maintain the piston 18 and the piston rod 38 in parallel alignment with the base plate to provide smooth and easy operation thereof. As the hydraulic pressure is continued to be applied to cylinder 18, the tire probe assembly 20 continues to move to the right until the desired length of the compacted tires is reached. This is indicated by a limit switch 60 as may be seen in FIG. 10 which acts through a valve, not shown, to stop further build-up of hydraulic pressure, but maintain enough hydraulic pressure to keep the compactor plates in the compressed position of FIG. 5.

Figure 2:
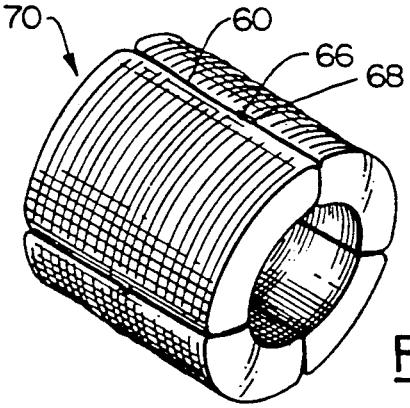
FIG. 2 is a view of a compacted bundle of tires formed on the machine of FIG. 1.
Figure 11:
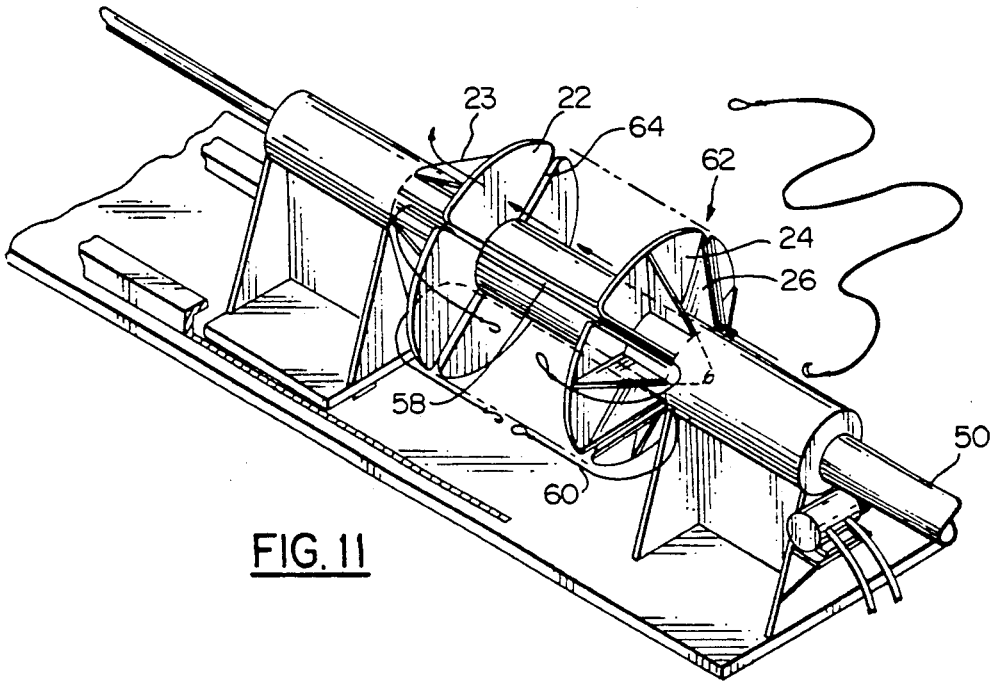
FIG. 11 is a perspective view of the device of FIG. 10 with the tires shown in phantom and illustrating the way the arrowhead wires are inserted through the slots and tracks and hooked together to secure a bundle of tires in the compacted condition.

An arrow head wire (FIG. 12) of suitable length is inserted in each of the four guides and slots at the ninety degree intervals around the circumference of the compactor plates 22 and 26. As shown in FIG. 11, an arrow head wire 60 is inserted through each guide channel 58 and slots 62 and 64 and then out around the outer surface of the tires. The ends are then hooked together with the hook 66 being inserted into the eye 68. The control system for the machine is then actuated to relax the pressure being exerted by the probe assembly 20 and compactor plate 22 to allow the tires to expand slightly and tension the four arrow wires 60 positioned about the bundle of tires. As soon as the wires 60 have been properly tensioned and are secure, the tire probe assembly 20 can be fully retracted out of the way and the bundle of compressed tires 70 removed from the machine resulting in the package shown in FIG. 2. This bundle of tires is greatly compressed from the approximately sixteen feet of tires shown in FIG. 3 to twenty to twenty-four inches of compressed tires shown in FIGS. 2 and 5. The bulky large number of tires can now be much more efficiently transported for further processing or disposal, as the case may be.

Figure 13:
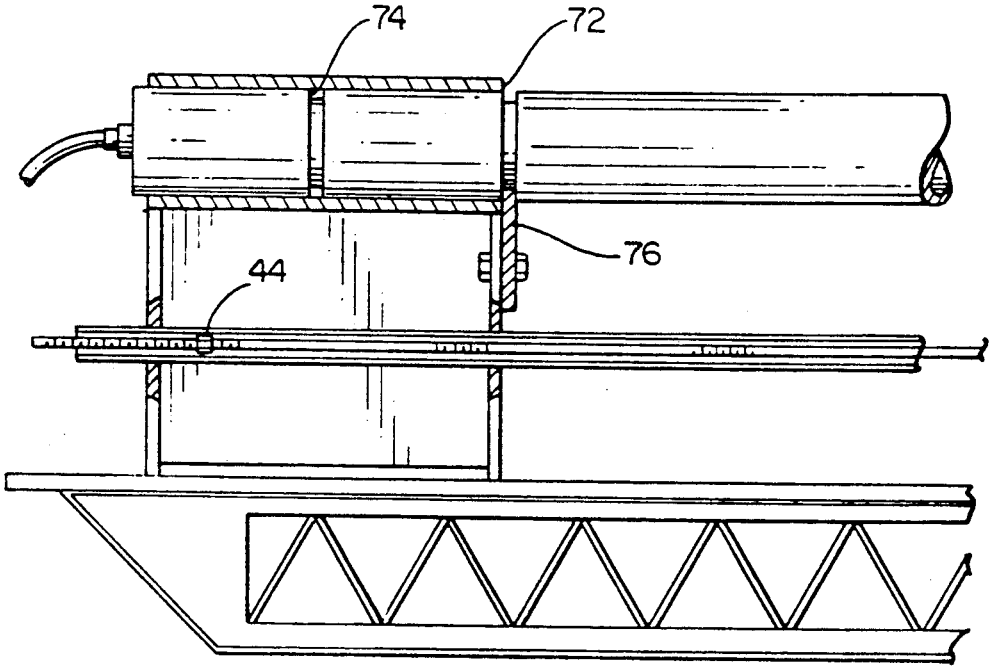
FIG. 13 is a partial cross-sectional view of the left-hand end of the machine of FIGS. 1 and 3-5.
Figure 14:
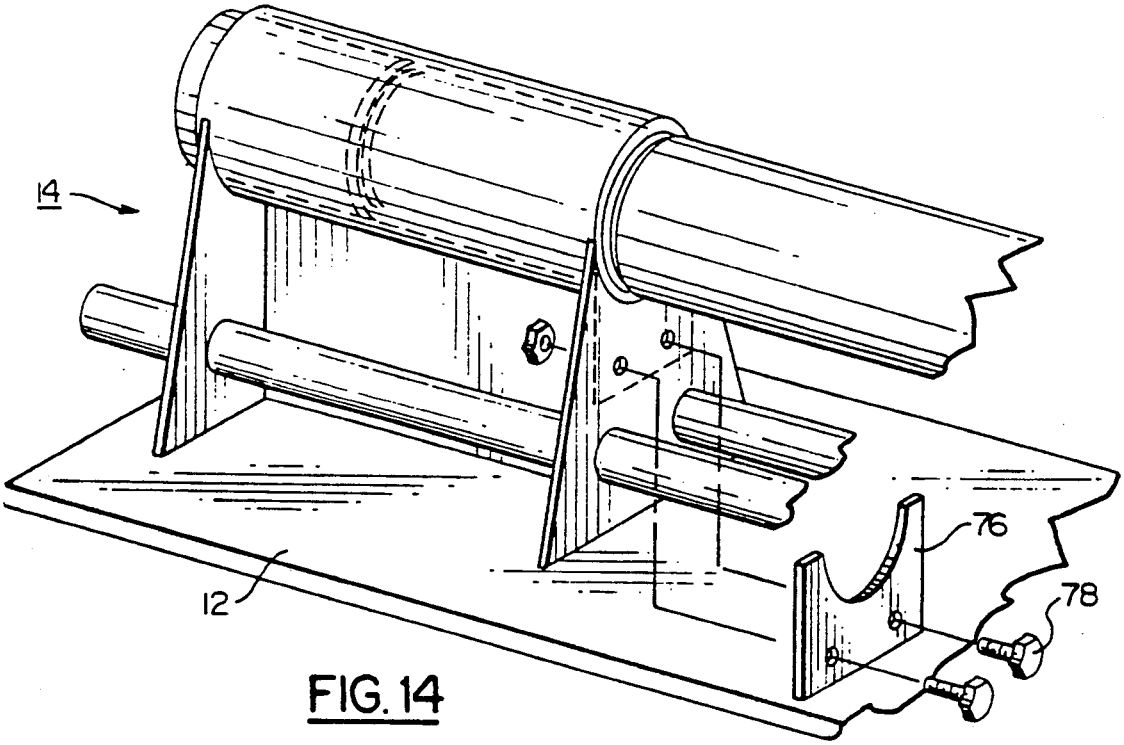
FIG. 14 is an enlarged scale view of the hydraulic cylinder mounting showing the positioning of the locking plate in one of the snap ring grooves in the cylinder housing.

Referring now to FIGS. 13 and 14, the embodiment shown includes a simple and easy way to adjust the length of the compacted bundle by changing the maximum distance that the tire probe assembly 20 can be moved. As shown in FIG. 13, two snap ring grooves 72 and 74 are provided in the outer circumference of the cylinder 18 and a locking plate 76 is provided for cooperative engagement in one of the grooves 72 or 74. The plate 76 is held in place with cap screws 78 so that the cylinder is fixed in the pedestal 14 which is fixed to base plate 12. In this manner, the maximum stroke of the cylinder relative to the pedestal 14 and base plate 12 is adjusted by the spacing between the two snap ring grooves 72 and 74. In the embodiment shown this has been chosen as ten inches so that the nominal maximum movement of the probe assembly 20 will result in a compressed bundle having a length of either twenty or ten inches. When the cylinder 18 is mounted on pedestal 14 using snap ring groove 72, the cylinder is extended to its maximum, the probe 24 is just entering into the fixed compactor plate 26 as shown in FIG. 10 and the distance between plates 22 and 26 is twenty inches. When the cylinder 18 is mounted on pedestal 14 using snap ring groove 74 the space between the two compactor plates will be cut in half and the probe 24 will extend into the bore of the fixed compactor plate 26 approximately ten inches.

In this embodiment, the limit of movement of cylinder 18 is basically controlled by the bottoming out of the piston when the cylinder bottoms out on the end closure of the cylinder 18. Alternatively, when a preset maximum pressure is reached in the hydraulic system it can trigger a control to maintain this maximum pressure on the cylinder 18 and the tire probe 20 which then determines the length of the compacted bundle. Such control systems are well known in the art and not shown herein for sake of simplicity. Thus, in operation the device compresses the tires until the desired preset length is reached or until a predetermined pressure is reached in which case the operator then has to determine whether the length is proper. If it is excessive, he has to back the machine off and remove one or more tires until the row of tires can be compressed to the desired length without exceeding the preset maximum pressure in the hydraulic system. This maximum pressure can also be used as a safety limit as is well known in the art. Applicant has disclosed three systems, namely a limit switch 60, the bottoming of the piston in the end of the cylinder, and a maximum pressure control. Other control systems will be apparent to those skilled in the art.

While this invention has been explained with reference to the structure disclosed herein, it is not confined to the details as set forth and this application is intended to cover any modifications and changes as may come within the scope of the following claims.

What is claimed is:

1. A machine for compacting a row of tires standing in side by side relationship which comprises:

a base platform for receiving thereon a row of tires to be compacted;

a first compactor plate sized to contact a tire to be compacted on the side surface thereof, said first compactor plate being fixed to one end of said base platform;

a second compactor plate corresponding in size to said first compactor plate positioned on said base platform for movement toward and away from said first plate;

an elongated hydraulic cylinder having an extendable piston rod operatively connected to said second compactor plate, mounted on said base platform at a predetermined distance from said first compactor plate;

means for extending said cylinder piston rod to move said second compactor plate into close proximity with said first compactor plate;

elongated retractable mandrel means mounted on said base platform for axial movement into and out of the row of tires to be compacted;

said mandrel means having a length sufficient to span the distance from one compactor plate to adjacent the other compactor plate before start of compaction;

means for moving said mandrel means from a retracted position into a row of tires to extend from one compactor plate to an extended position adjacent the other compactor plate before compaction; and means for retracting said mandrel means from the extended position toward the retracted position upon compaction of said tires.

2. A machine according to claim 1 wherein said second compactor plate includes a tire probe member extending outwardly from the center thereof toward said first compactor plate a distance approximately equal to the length of the largest compacted tire bundle to be formed.

3. A machine according to claim 2 wherein said probe member and said mandrel means are tubes formed so that the distal end of each will mate with the other when the mandrel means is inserted through the row of tires thereby forming a continuous alignment and safety mandrel for the interior of a row of tires during the compaction process preventing misalignment or ejection of individual tires within the row.

4. A machine according to claim 2 further including a plurality of wire guiding tracks and slots positioned about said probe and end plate assemblies so that when a row of tires is compacted a corresponding plurality of arrowhead wires may be inserted through said slots and tracks and secured about a compacted row of tires to secure the tires together to permit the compactor plates to be withdrawn and the bundles of compacted tires removed from the machine.

5. A machine according to claim 4 wherein said plurality of tracks and slots comprises four slots in each compactor plate and four tracks spaced about said probe at 90 degree intervals; said slots and track being positioned in axial alignment with each other.

6. The machine according to claim 1 wherein said hydraulic cylinder is adjustably mounted at one end of said base plate in a first position to produce a compacted tire bundle having a first length and in a second position to produce a compacted tire bundle having a second length.

7. The machine according to claim 6 wherein the adjustable mount of said cylinder includes a pair of snap ring grooves formed in the outer surface of said hydraulic cylinder at first and second positions and a locking plate formed to fit in one of said grooves to fix said cylinder in a first or second position.

8. A machine according to claim 1 wherein said means for moving said mandrel means includes:

a rack gear mounted along the length of said mandrel means;

a hydraulic motor mounted on said first compactor plate assembly adjacent said mandrel means;

a pinion gear fixed on the output shaft of said hydraulic motor in engagement with said rack gear; and means for supplying hydraulic fluid to said hydraulic motor so that said mandrel means may be moved axially into and out of the core of a row of tires.

9. A machine for compacting an elongated row of tires standing vertically in side by side relationship which comprises:

a base platform for receiving thereon a row of tires to be compacted;

a first compactor plate sized to contact a tire to be compacted throughout the side surface thereof, said first compactor plate being fixed to one end of said base platform;

a second compactor plate corresponding in size to said first contactor plate positioned on said base platform for movement toward and away from said first plate;

an elongated hydraulic cylinder having an extendable piston rod operatively connected to said second compactor plate, mounted on said base platform at a predetermined distance from said first compactor plate;

means for extending said cylinder piston rod to move said second compactor plate into close juxtaposition to said first compactor plate;

cylinder support means slidably mounted on said base platform having a cradle for slidably receiving therein the outer surface of said elongated hydraulic cylinder; and means for moving said cylinder support means along said base platform proportionally to the movement of said second compactor plate to maintain said hydraulic cylinder and piston rod in alignment with said base platform during compaction of a row of tires.

10. A machine according to claim 9 further including:

elongated mandrel means mounted on said base platform for axial movement into and out of the row of tires to be compacted;

said mandrel means having a length sufficient to reach from the first to the second compactor plate before start of compaction;

means for moving said mandrel means into a row of tires; and means for retracting it from the row of tires in direct proportion to the compaction of the row of tires.

11. A machine according to claim 10 further including means for positioning a plurality of arrowhead wires about a compacted row of tires to form a bundle for removal from the machine.

12. A machine according to claim 9 wherein said means for moving said cylinder support means comprises a pair of tie rods fixed at one end to said second compactor plate;

said tie rods being threaded at the other end and extending through said cylinder support means in frictional engagement therewith; and stop nut means threaded on the ends of said tie rods.

13. A machine according to claim 9 further including means connecting said second compactor plate and cylinder support means comprising; at least one tie rod fixed at one end to said compactor plate said tie rod being frictionally engaged in said cylinder support means, and a stop nut at the other end of said tie rod to limit the maximum distance between said second compactor plate and cylinder support whereby said cylinder support is pulled along by said second compactor plate as said extendable piston rod extends to its maximum stroke to maintain the distal end of said cylinder at a constant predetermined spacing from said base plate.

14. The machine according to claim 9 wherein said hydraulic cylinder is adjustably mounted at one end of said base plate in a first position to produce a compacted tire bundle having a first length and in a second position to produce a compacted tire bundle having a second length.

15. The machine according to claim 14 wherein said hydraulic cylinder is adjustably mounted at one end of said base plate and the adjustable mount of said cylinder includes a pair of snap ring grooves formed in the outer surface of said hydraulic cylinder at first and second positions and a locking plate formed to fit in one of said grooves to fix said cylinder in a first or second position.

16. A machine according to claim 9 further including a cylindrical probe member formed with and extending outwardly from said second compactor plate toward said first compactor plate along the axis of said plates;

said probe being formed to extend into the center of tires positioned in the machine for compaction; and said extendable piston rod being positioned to extend through said cylindrical probe and to be attached to the inner surface of the outwardly extending end of the probe member so that when the extendable piston rod is fully retracted into said hydraulic cylinder, the probe member will be telescoped over the end of said hydraulic cylinder.

* * * * *